US009744650B2

(12) United States Patent
Kregloski

(10) Patent No.: US 9,744,650 B2
(45) Date of Patent: Aug. 29, 2017

(54) DRIVE ASSEMBLY FOR USE WITH THE HANDLE GRIP OF A CLAMPING DEVICE

(71) Applicant: RHEA BROTHERS LLC, Brookfield, WI (US)

(72) Inventor: Scott P. Kregloski, Shorewood, WI (US)

(73) Assignee: Rhea Brothers LLC, Brookfield, WI (US)

( * ) Notice: Subject to any disclaimer, the term of this patent is extended or adjusted under 35 U.S.C. 154(b) by 0 days.

(21) Appl. No.: 14/855,588

(22) Filed: Sep. 16, 2015

(65) Prior Publication Data

US 2016/0001425 A1 Jan. 7, 2016

Related U.S. Application Data

(60) Provisional application No. 62/129,619, filed on Mar. 6, 2015.

(51) Int. Cl.
*B25B 5/16* (2006.01)
*B25B 5/10* (2006.01)

(52) U.S. Cl.
CPC ..... *B25B 5/16* (2013.01); *B25B 5/102* (2013.01)

(58) Field of Classification Search
CPC B25B 5/067; B25B 5/068; B25B 5/10; B25B 5/101; B25B 5/102; B25B 1/18
See application file for complete search history.

(56) References Cited

U.S. PATENT DOCUMENTS 1,411,013 A * 3/1922 Gilmore ..... B25B 5/102 269/240
2,527,492 A * 10/1950 Cleary ..... B25B 23/0035 279/104
4,770,401 A * 9/1988 Donaldson ..... B25B 1/18 269/225
5,241,736 A * 9/1993 Allison ..... B25B 5/101 29/257
5,427,364 A 6/1995 Zborschil
6,098,973 A 8/2000 Khachatoorian
6,296,241 B1 10/2001 Harrison
6,367,790 B2 4/2002 Ocklenburg et al.
6,726,193 B1 4/2004 Yates
(Continued)

FOREIGN PATENT DOCUMENTS

DE 10025077 4/2001

*Primary Examiner* — Joseph J Hail
*Assistant Examiner* — Tyrone V Hall, Jr.
(74) *Attorney, Agent, or Firm* — Joseph S. Heino; James E. Lowe, Jr.

(57) ABSTRACT

A clamp assembly a fixed end support, a movable end support and a handle disposed in one end support or the other. The handle is rotated using an electric tool, such as a drill. A female receiver is disposed within a rearward end of the handle. A male driver is removably held within a chuck of the electric drill and is inserted into the receiver to rotate and then tighten or loosen the support end of the clamp. Alternatively, the clamp assembly has a male portion that is disposed at a rear portion of an end support and a female driver is used to rotate and then tighten or loosen the clamp from the wood pieces. The female receiver and male driver can be used with either a movable end support or a stationary end support of the clamp, as could the male portion and the female driver.

9 Claims, 5 Drawing Sheets

(56) References Cited

U.S. PATENT DOCUMENTS

| | | | | |
|---|---|---|---|---|
| 7,219,885 | B2 | 5/2007 | Nardozza | |
| 7,293,765 | B2 * | 11/2007 | Hooper | B25B 1/103 269/246 |
| 7,588,223 | B2 | 9/2009 | Wolvin | |
| 7,850,154 | B2 | 12/2010 | Feuge | |
| 8,083,443 | B1 | 12/2011 | Circosta et al. | |
| 8,641,024 | B1 | 2/2014 | Murray et al. | |
| 2004/0232631 | A1 * | 11/2004 | Chen | B23B 31/1071 279/75 |
| 2005/0262680 | A1 * | 12/2005 | Martz | B25B 25/00 29/257 |
| 2008/0014035 | A1 | 1/2008 | Perkovich et al. | |
| 2009/0020935 | A1 * | 1/2009 | Feuge | B25B 5/102 269/164 |
| 2010/0244348 | A1 | 9/2010 | Castor et al. | |
| 2011/0271498 | A1 * | 11/2011 | Price | B25B 5/102 24/457 |

* cited by examiner

DRIVE ASSEMBLY FOR USE WITH THE HANDLE GRIP OF A CLAMPING DEVICE

This application claims the benefit and priority of U.S. Provisional Patent Application No. 62/129,619 filed Mar. 6, 2015.

FIELD OF THE INVENTION

This invention relates generally to devices and assemblies that are used to hold or "clamp" pieces of wood or other materials together (collectively, a "piece" or "pieces"). It also relates generally to bar clamps or other clamping devices (collectively, a "clamp") having a first clamping surface and a second clamping surface, the first and second clamping surfaces forming a "throat" between them. In use, the piece is placed within the throat of the clamp such that the piece or pieces can be firmly held within the clamp. Further, the first and second clamping surfaces can be fixed and/or movable toward or away from one another with one of the clamping surfaces being movable via a rotatable handle for hand or manual clamp tightening and loosening of the piece or pieces that are placed within the throat of the clamp.

More specifically, the present invention relates to a drive assembly that can be built into such a clamp whereby the clamp can be tightened or loosened relative to the piece or pieces by using the drive assembly of the present invention. Such a drive assembly would complement manual or hand tightening and loosening of the clamp, rather than replace it. When used, the drive assembly would allow the clamp to be tightened or loosened more quickly and tighter thereby reducing the time necessary to apply the clamp, or more typically a plurality of clamps, to the piece or pieces being worked, and applying more pressure to the wood piece being worked.

BACKGROUND OF THE INVENTION

In the craft of woodworking, it is often necessary to hold two or more pieces of wood together, such as when adjacent surfaces of the pieces are glued together. Using a clamp serves to maintain the relative positions of the pieces until the glue has dried, at which point the clamp is removed. In some instances, it is necessary to retain a plurality of such wood pieces together and the wood pieces are relatively long such that a number of clamps are required. In such cases, it is not at all unusual for the craftsman to use multiple clamps in multiple locations or positions such that the clamps are spaced apart by only a few inches. This allows the craftsman to apply somewhat equal pressure to the wood pieces along their full lengths.

As to the specific structure or type of clamp with which the assembly of the present invention can be used or incorporated, the clamp must have several essential elements. For purposes of this portion of the disclosure, it will be assumed that the type of clamp used is a bar clamp, sometimes configured as an "F-clamp" or as a "step over" clamp, the former of which will be discussed further in the detailed description of this disclosure. That is, the F-clamp and the bar clamp will be discussed here for purposes of presenting the concept behind the present invention. The F-clamp has a first end that is fixed in position and is disposed transversely at the end of a longitudinally-extending bar. In short, this is a fixed end support. Disposed along the bar is a movable end support, which is transversely-disposed relative to the bar and is movable along the bar, and typically includes a clutch mechanism for fixing the position of the movable end support along the bar. The two supports and the bar are configured as a structure that is formed in somewhat of an "F" shape—hence the name "F-clamp."

The words "clamp," "bar clamp," "F-clamp," "step over clamp" and "pipe clamp" may be used interchangeably but are to be understood to mean the same or similar device, or type of device, with which the assembly of the present invention can be used. In the preferred assembly, the fixed end support and the movable end support include protective pressure caps or pads, which pads prevent any unwanted pressure indentations or impressions being imparted into the final wood product by either end support.

That portion of the clamp between the end supports is sometimes referred to as the "throat" of the clamp. It is within this throat that the wood pieces are placed. Once placed within the throat of the clamp, the movable end support is advanced toward the wood pieces to roughly position the movable end support adjacent the wood pieces. The movable end support is further configured with a threaded member which includes a rotatable screw-like portion having a handle. The handle is permanently attached to the movable end support and typically disposed parallel to the bar of the clamp. Manual rotation of the handle serves to advance the screw-like portion of the movable end support toward the wood pieces and tighten them between the clamp end supports, all within the throat of the clamp. It is to be understood, however, that this is not the only type of clamp with which the assembly of the present invention can be used, as will be apparent later in the detailed description. It is also to be understood that use of the device and assembly of the present invention is not limited to "pieces" that are made of wood. Other materials may be placed within such clamps and such applications are fully within the scope of this invention.

By way of specific example, and supposing that a craftsman is creating a table top which has a dozen or so pieces of hardwood board in it, the boards will need to be placed side-by-side with glue placed between the adjacent faces of each board. The number of boards used would depend on the width of each board and the desired width of the table top. If the table top is designed to be four feet long, the boards would need to be at least four feet long—to allow for end trimming to square the end surface of the table later on in the crafting fabrication process. The only practical way of accomplishing this placement and gluing with a dozen or so boards, and to maintain the relative position of the boards as the glue between them dries, is to use a number of bar clamps. Each bar clamp would be positioned transversely relative to the boards and then secured in position. This would be repeated with a number of bar clamps placed at other points along the table top. The handle of each bar clamp would then be tightened, by hand, to secure the wood pieces within all of the bar clamps. It may also be necessary to place a number of clamps in an inverted position. Each bar clamp would then be secured in succession, and using the hand-tightening method, until all handles of the bar clamps are manually tightened to a desired pressure.

In this example, it can be appreciated that manual tightening, followed by manual untightening, of the bar clamp handle is both laborious and time consuming, particularly when a plurality of such clamps are used for a given wood crafting project.

In the view of this inventor, there is a need to provide an improved drive assembly that makes tightening and untightening of the clamps easier for the craftsman and that reduces the amount of time it takes to do so, particularly when a plurality of clamps are used. There is also a need for such a drive assembly whereby manual labor is reduced, which can result in a safer approach to wood clamping by, among other things, reducing carpal tunnel syndrome by overuse of the user's wrists which typically bear the brunt of efforts to tighten and loosen the clamp.

SUMMARY OF THE INVENTION

The drive assembly of the present invention meets this need. It provides a first preferred embodiment for a modified clamp such that the handle of the clamp can be rotated using an electric tool, such as a drill—which can be referred to as the "drive device" of the drive assembly. Disposed within the rearward end of the handle is a female receiver. A male driver, which is removably held within the chuck of the electric drill, would be inserted into the receiver such that the electric tool can be used to rotate and then tighten or loosen the movable end support of the clamp from the wood pieces. In a second preferred embodiment, the modified clamp includes a male portion that is disposed on a rear portion of the fixed end support and a female driver may be used with the male portion to rotate and then tighten or loosen the clamp from the wood pieces. Of course, the female receiver and male driver can be used with either the movable end support or the stationary end support of the clamp, as could the male portion and the female driver, all in accordance with the present invention.

The foregoing and other features of the present invention will be apparent from the detailed description that follows.

DETAILED DESCRIPTION

Figure 1:
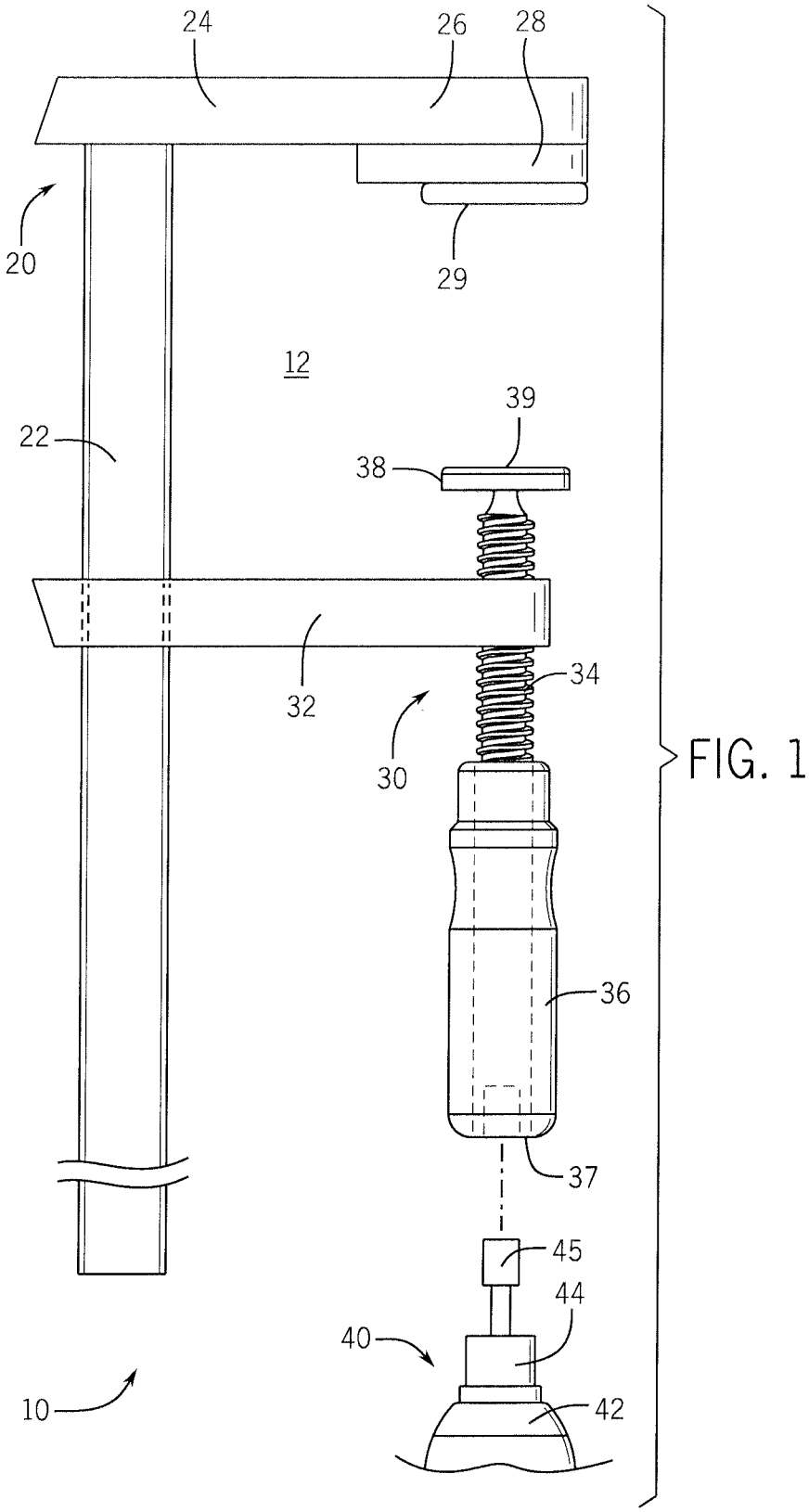
FIG. 1 is a partial side view of a step over clamp which uses the drive assembly in accordance with the present invention, and showing the drive device disengaged from the handle of the movable end support.

Referring now to the drawings in detail wherein like numbers represent like elements throughout, FIG. 1 illustrates a drive assembly, generally identified 10, that is constructed in accordance with the present invention. In the illustrated embodiment, an F-clamp 20 is shown. The clamp 20 comprises a straight and longitudinally-extending rail or bar 22 which terminates at a fixed end portion 24. The fixed end portion 24 comprises a fixed end support 26 to which is attached an end cap or pressure cap 28. The end cap 28 comprises a clamping surface or face 29 against which the wood boards to be worked (not shown) would be secured from one side. An opposing face 39, which is part of a movable end support 30, provides an opposing clamping surface. Between the clamping surfaces 29, 39 is the throat 12 of the assembly 10, which is where the wood to be worked is placed.

The movable end support 30 comprises an end support body 32 which can slide along the straight bar 22 of the clamp 20 via an aperture or opening (shown in phantom view in FIG. 1) formed within the support body 32. The movable support end body 32 is also fixable at points along the bar 22 via a clutch (not shown) of the type which is known in the art. Transversely disposed relative to the movable support end body 32 is a threaded screw portion 34 which mates with a like-threaded aperture (also not shown) in the end body 32. This structure also includes the clamping surface 39 of a support end 38 and a fixed handle 36, the handle 36 being "fixed" in relation to the screw portion 34 but rotatable relative to the support body 32. As shown in FIG. 1, the handle 36 also comprises an end face 37. Lastly, an electric drill 42 or other type of rotational tool having a chuck 44 is provided, the chuck 44 being configured to receive a portion of a male driver 45. Together with an aperture 35 of the movable end support handle 36, the drill 42, chuck 44 and driver 45 are considered to be the "drive device" 40 of the assembly 10.

Figure 2:
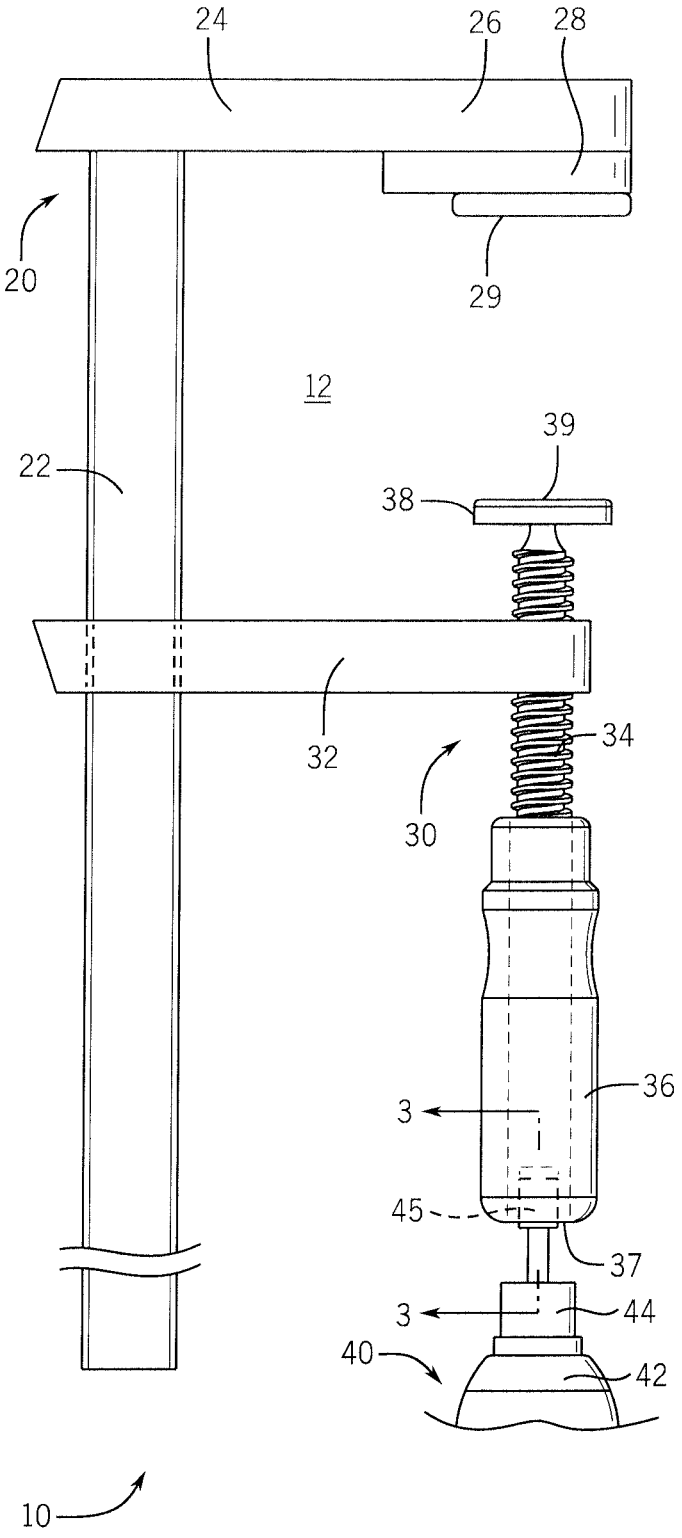
FIG. 2 is the same view as that of FIG. 1 and showing the drive device engaged with the movable end support handle.
Figure 3:
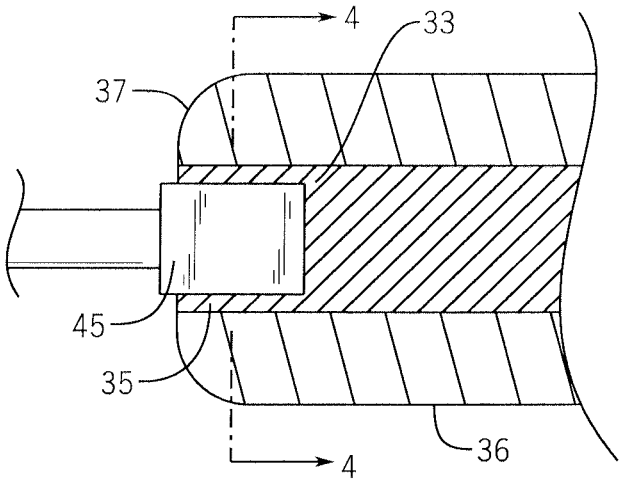
FIG. 3 is an enlarged cross-sectioned view taken along line 3-3 of FIG. 2 and showing the engaged portions of the drive device and the handle of the movable end support.
Figure 4:
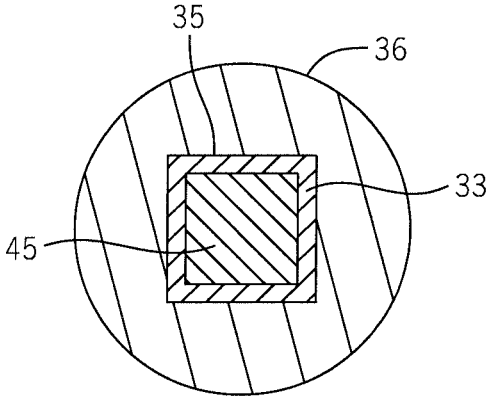
FIG. 4 is an enlarged cross-sectioned view taken along line 4-4 of FIG. 3 and also showing the engaged portions of the drive device and the handle of the movable end support.

Referring now to FIG. 2, it shows the drive device 40 engaged with the movable end support handle 36. Specifically, the end face 37 comprises a square-shaped aperture 35. See FIGS. 3 and 4 also. The aperture 35 of the movable end support handle 36 is configured to mate with the contour of the driver 45 such that, upon actuation of the drill 42, the drive device 40 can rotate the handle 36 inwardly or outwardly and in a fashion that is much quicker than can be accomplished by hand. As shown, the aperture 35 may include a liner 33 for purposes of reinforcing the handle 36, which is typically made from wood. As alluded to at the outset, this inventive aspect of the present disclosure results in an improved drive assembly 10 that makes tightening and untightening of the movable end support 30 easier for the craftsman and reduces the amount of time it takes to do so, particularly when a plurality of clamps are used.

Figure 5:
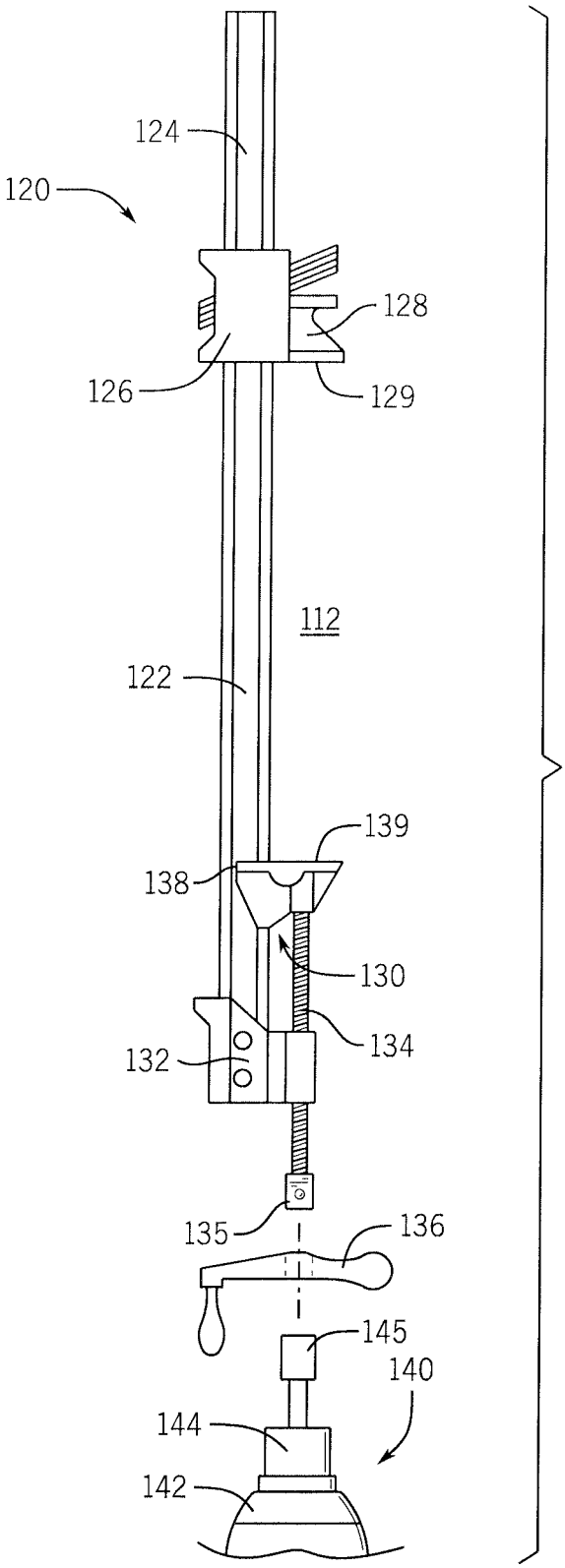
FIG. 5 is a partial side view of a step over clamp having a different handle configuration and which uses the drive assembly in accordance with the present invention and shows the drive device disengaged from the fixed end support handle.
Figure 6:
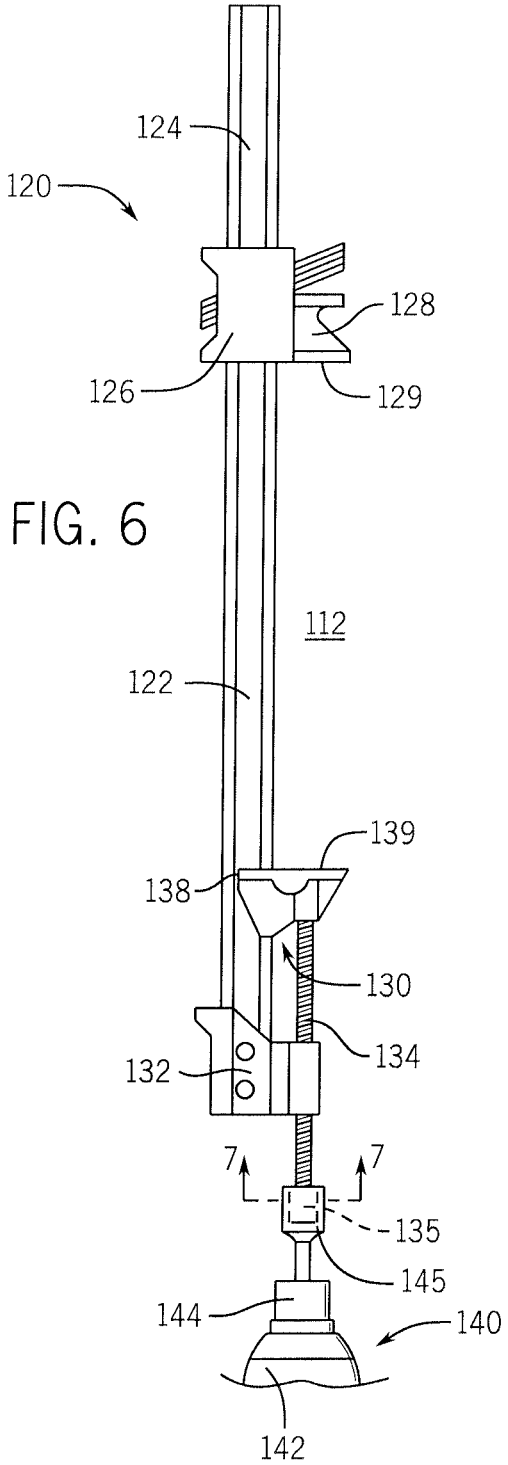
FIG. 6 is the same view as that of FIG. 5 and showing the drive device engaged with the fixed end support handle.

Referring now to FIGS. 5 and 6, they illustrate an alternative embodiment of the drive assembly, generally identified 110, that is constructed in accordance with the present invention. In this embodiment, a bar clamp 120 is shown, although it is to be understood that other clamps could be used as part of either assembly 10, 110. In this second embodiment, the clamp 120 comprises a straight and longitudinally-extending rail or bar 122 having a first end portion 124 along which a movable support body 126 can move longitudinally and be fixed via a clutch (not shown) of the type which is known in the art. The movable support body 126 comprises an end cap or pressure cap 128. The end cap 128 comprises a clamping surface or face 129 against which the wood boards to be worked are secured from one side. An opposing face 139, as with the first embodiment, provides an opposing clamping surface. Between the clamping surfaces 129, 139 is the throat 112 of the assembly 110.

Further, a second end support 130 is provided which comprises a support body 132 which is fixed to one end of the bar 122 and a movable portion 138 which can limitedly slide along a short portion of the straight bar 122 of the clamp 120 via an opening (not shown) in the support body 132. The movable portion 138 comprises the clamping surface 139 and is attached to one end of a threaded screw portion 134 which mates with a like-threaded aperture (not shown) in the support body 132. This structure also includes a handle 136, the handle 136 being rotatable relative to the support body 132. The handle 136 of this embodiment is a bit different in that the handle 136 lies generally perpendicular to the screw portion 134 which affords this handle 136 a bit more torque capability. The screw portion 134 comprises an end 135, the end 135 being shown as a square structure. As shown in FIG. 5, it is to be understood that the handle 136 can be secured to the screw portion end 135 as well, but can also be removed from it. That is, the handle 136 is removably secured to the end 135 of the screw portion 134 via a quick release mechanism, such as a ball and detent arrangement that is known in the art. Lastly, an electric drill 142 or other type of rotational tool having a chuck 144 is provided, the chuck 144 being configured to receive a portion of a female driver 145. Together with the end 135 of the screw portion 134, the drill 142, chuck 144 and driver 145 are considered to be the "drive device" 140 of this particular assembly 110.

Figure 7:
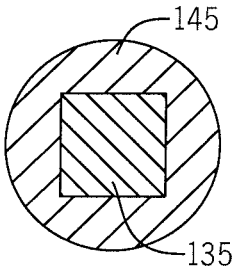
FIG. 7 is an enlarged cross-sectioned view taken along line 7-7 of FIG. 6 and showing the engaged portions of the drive device and the fixed end support handle.

Referring to FIG. 6, it shows the drive device 140 engaged with the screw portion end 135, which is a square-shaped male portion. See also FIG. 7. This male portion 135 is configured to mate with the contour of the driver 145 such that, upon actuation of the drill 142, the drive device 140 can rotate the screw portion 134 inwardly or outwardly and in a fashion that is done more quickly than can be done by hand, even with a handle 136 that is configured to provide more torqueing ability for the craftsman.

In accordance with the foregoing, it will be appreciated that there has been provided an improved drive assembly 10, 110 that makes tightening and untightening of clamps easier for the craftsman and that reduces the amount of time it takes to do so, particularly when a plurality of clamps, such as the one shown in FIGS. 5 and 6, are used. It will also be appreciated that a female receiver and male driver can be used with either the movable end support or the stationary end support of the clamp, as could the male portion and the female driver, all such variations being included within the scope of the present invention.

The details of the invention having been disclosed in accordance with the foregoing, I claim:

1. A clamp drive assembly that is actuated using an electric tool, such as a drill having a chuck, the assembly comprising:

a clamp, the clamp comprising a bar;

a first end support that is fixed at a point along the bar;

a second end support that is moveable along the bar, a threaded aperture in one of the first end support and the second end support, and the second end support further comprising a like-threaded rotatable screw-like portion received within the threaded aperture;

a handle grip for the clamp, the handle grip being made of wood and further comprising a forward end attached to the rotatable screw-like portion of the second end support, and the handle grip having a rearward end on an opposite side of the forward end; and a drive device to rate the handle grip via the electric tool, the drive device comprising a female receiver disposed within the rearward end of the handle grip; the female receiver being a metal liner for reinforcing the handle grip, and a male driver adapted to be disposed inside the female receiver, the male driver being adapted to be removably held within the electric tool chuck of the drill to rotate the handle grip via the drill.

2. The clamp drive assembly of claim 1 wherein the male driver is held within the chuck of an electric drill.

3. The clamp drive assembly of claim 1 wherein the female receiver and the male driver are complementary in shape and wherein that shape is square.

4. The clamp drive assembly of claim 1 wherein the handle grip is removable and the rotatable screw-like portion comprises a male portion that mates with a female driver.

5. A clamp drive assembly that is actuated using an electric tool, such as a drill having a chuck, the assembly comprising:

a clamp, the clamp comprising a bar;

a first end support that is fixed at a point along the bar, a threaded aperture in one of the first end support and a second end support, a like-threaded rotatable screw-like portion received within the threaded aperture, and a rearward end portion of the screw-like portion;

the second end support being movable along the bar;

a removable handle grip for the clamp, the handle grip being made of wood and further comprising a forward end and a rearward end on an opposite side of the forward end, wherein the forward end is removably attached to the rearward end portion of the rotatable screw-like portion of the first end support; and a drive device to rotate the rearward end of the screw-like portion via the electric tool, the drive device comprising a female receiver disposed within the rearward end of the handle grip; the female receiver being a metal liner for reinforcing the handle grip, and a male driver adapted to be disposed inside the female receiver, the male driver being adapted to be removably held within the electric tool chuck of the drill to rotate the handle grip via the drill.

6. The clamp drive assembly of claim 5 wherein the male driver is held within the chuck of an electric drill.

7. The clamp drive assembly of claim 5 wherein the male driver and the female receiver are complementary in shape and wherein that shape is square.

8. The clamp drive assembly of claim 5 wherein the rearward end portion and handle grip are attached via a quick release mechanism.

9. The clamp drive assembly of claim 8 wherein the quick release mechanism comprises a ball and detent structure.

* * * * *